US006194886B1

(12) United States Patent
D'Aquino et al.

(10) Patent No.: US 6,194,886 B1
(45) Date of Patent: Feb. 27, 2001

(54) EARLY VOLTAGE AND BETA COMPENSATION CIRCUIT FOR A CURRENT MIRROR

(75) Inventors: Stefano I. D'Aquino, Westford; Adrian P. Brokaw, Burlington; Kimo Y. F. Tam, Arlington; David H. Whitney, Westford, all of MA (US)

(73) Assignee: Analog Devices, Inc., Wilmington, MA (US)

( * ) Notice: Subject to any disclaimer, the term of this patent is extended or adjusted under 35 U.S.C. 154(b) by 0 days.

(21) Appl. No.: 09/425,782

(22) Filed: Oct. 25, 1999

(51) Int. Cl.[7] ..... G05F 3/16; G05F 3/20
(52) U.S. Cl. ..... 323/315; 323/313
(58) Field of Search ..... 323/315, 314, 323/316, 313

(56) References Cited

U.S. PATENT DOCUMENTS

| | | | | |
|---|---|---|---|---|
| 4,398,160 | * | 8/1983 | Neidorff | 330/288 |
| 4,814,724 | * | 3/1989 | Tanigawa | 323/315 |
| 5,132,556 | * | 7/1992 | Cheng | 323/316 |
| 5,164,658 | * | 11/1992 | Kuwahara | 323/315 |
| 5,506,543 | * | 4/1996 | Yung | 330/253 |
| 5,633,612 | * | 5/1997 | Lee | 323/315 |
| 5,637,993 | | 6/1997 | Whitney et al. | 323/315 |
| 5,801,523 | * | 9/1998 | Bynum | 323/315 |
| 5,867,067 | * | 2/1999 | Moriarty, Jr. | 330/288 |
| 6,034,518 | * | 3/2000 | Yuasa | 323/316 |

* cited by examiner

*Primary Examiner*—Peter S. Wong
*Assistant Examiner*—Bao Q. Vu
(74) *Attorney, Agent, or Firm*—Iandiorio & Teska

(57) ABSTRACT

An Early voltage and beta current compensated cascode current mirror includes a cascode current mirror having an input stage responsive to an input current, a current mirror circuit having a first stage responsive to the input stage and a second stage responsive to the first stage, and an output stage responsive to the second stage for providing an output voltage and current; and a compensation circuit, responsive to the cascode current mirror, having a first compensation stage, a second compensation stage and a bootstrapping buffer, the first compensation stage, in response to a change in the output voltage, impressing a corresponding change in voltage on the second compensation stage, the second compensation stage thereby providing a change in current to the cascode current mirror for cancelling current errors induced by base current modulation in the output stage, the bootstrapping buffer, in response to the change in voltage, impressing a corresponding change in voltage on the first compensation stage to prevent errors from base current modulation effects in the first compensation stage, the first and second compensation stages further providing a base current to the cascode current mirror for cancelling base current errors in the output current induced by the cascode current mirror.

15 Claims, 4 Drawing Sheets

EARLY VOLTAGE AND BETA COMPENSATION CIRCUIT FOR A CURRENT MIRROR

FIELD OF INVENTION

This invention relates to current mirrors and more particularly to a compensation circuit for a cascode current mirror for cancelling Early voltage and base current errors.

BACKGROUND OF INVENTION

Many circuits rely on current mirrors for providing replicas of some input current. Current mirrors are designed to provide an output current which follows, or mirrors, the input current, or is a multiple thereof. However, inherent problems prevent the output current from identically matching the input current. Two problems in particular, base currents and base current modulation, contribute undesirable variations to the output current which result in an output current which does not follow the input current. Base currents, and hence base current errors, result from finite transistor beta. In contrast, finite Early voltage and changes in the mirror output voltage lead to base current modulation errors. While it has been possible to compensate for each of these respective errors individually, to date, it has not been possible to easily cancel both errors with a single, simple compensation circuit. This invention provides an auxiliary output node for sampling the cascode mirror output voltage without imposing a penalty in terms of simplicity, transistor count, compactness, or accuracy.

BRIEF SUMMARY OF THE INVENTION

It is therefore an object of this invention to provide a compensation circuit for a cascode current mirror which cancels base current errors and base current modulation errors.

It is a further object of this invention to provide such a compensation circuit which simultaneously cancels both base current errors and base current modulation errors.

It is a further object of this invention to provide such a compensation circuit which cancels base current errors and base current modulation errors in a single circuit which is simple and easily implemented.

The invention results from the realization that a truly effective error compensated current mirror can be achieved with a compensation circuit which, in response to a change in the current mirror output voltage, applies the same change in voltage to a compensation stage which provides a change in current to the current mirror due to base current modulation effects inherent to the compensation stage to cancel base current modulation errors in the current mirror, the compensation circuit further using the base currents of the compensation circuit to cancel base current errors inherent to the current mirror so that output current of the current mirror mirrors the input current.

This invention features an Early voltage and beta compensated cascode current mirror. There is a cascode current mirror including an input stage, responsive to an input current, a current mirror circuit having a first stage responsive to the input stage and a second stage responsive to the first stage, and an output stage responsive to the second stage for providing an output voltage and current. There is a compensation circuit, responsive to the cascode current mirror, including a first compensation stage, a second compensation stage and a bootstrapping buffer stage, the first compensation stage, in response to a change in the output voltage, impresses a corresponding change in voltage on the second compensation stage, the second compensation stage thereby providing a change in current to the cascode current mirror for cancelling current errors induced by base current modulation in the output stage. The bootstrapping buffer, in response to the change in voltage, impresses an equal change in voltage on the first compensation stage to prevent errors from base current modulation effects in the first compensation stage. The first and second compensation stages further provide base current to the cascode current mirror for cancelling base current errors in the output current induced by the cascode current mirror.

In a preferred embodiment the input stage and first stage may form a first leg, the output stage and second stage may form a second leg and the first and second compensation stages may form a third leg, the first, second and third legs having normalized nominal currents of 1, Y, and Y·(1+Y), respectively, where Y is the current gain of the cascode current mirror. Each stage may include a transistor. The input transistor and first transistor may be diode connected. The first compensation transistor may provide a compensation current to the output transistor and the second compensation transistor may provide a compensation current to the second transistor to cancel base current errors. The bootstrapping transistor may be a PNP bipolar transistor and the first and second transistors may be NPN bipolar transistors. The bootstrapping transistor may be a NPN bipolar transistor, and the first and second transistor may be PNP bipolar transistor.

The invention also features a beta current and Early voltage compensation circuit for a current mirror with an output stage for providing an output voltage and current gain Y. There is a first compensation stage, responsive to a change in the output voltage; a second compensation stage, responsive to the first compensation stage, for providing a current to the output stage; and a bootstrapping buffer, responsive to the change in output voltage, the first compensation stage, in response to the change in the output voltage, impresses an equal change in voltage on the second compensation stage, the second compensation stage thereby providing a change in current to the current mirror for cancelling current errors induced by base current modulation in the output stage. The bootstrapping buffer, in response to the change in voltage, impresses a corresponding change in voltage on the first compensation stage to prevent errors from base current modulation effects in the first compensation stage, the first and second compensation stages further providing a base current to the cascode current mirror for cancelling base current errors in the output current by the cascode current mirror.

In a preferred embodiment the first and second compensation stages, or third leg, may have a normalized nominal current of Y·(1+Y) with respect to the first leg. Each stage may include a transistor. The bootstrapping transistor may be a PNP bipolar transistor, and the first and second compensation transistors are NPN bipolar transistors. The bootstrapping transistor may be an NPN bipolar transistor, and the first and second compensation transistors may be PNP bipolar transistors.

BRIEF DESCRIPTION OF THE DRAWINGS

Other objects, features and advantages will occur to those skilled in the art from the following description of a preferred embodiment and the accompanying drawings, in which.

DETAILED DESCRIPTION OF A PREFERRED EMBODIMENT

Figure 1:
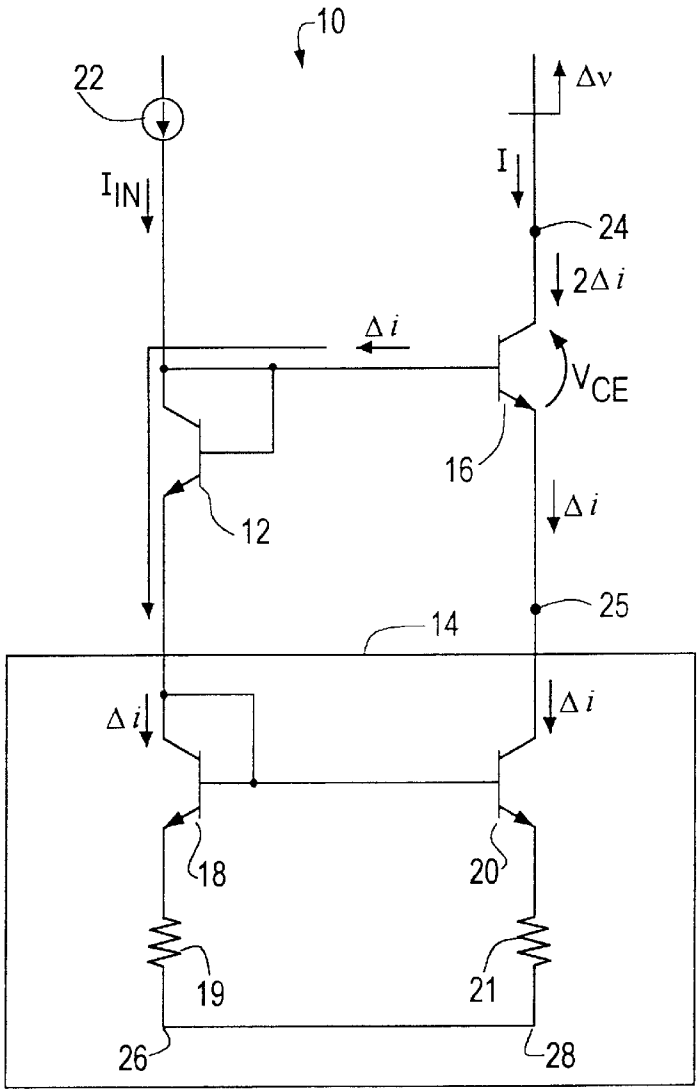
FIG. 1 is a detailed schematic diagram of a prior art uncompensated cascode current mirror demonstrating the effects of base current modulation errors on the output current of the cascode current mirror.

Prior art uncompensated cascode current mirror 10, FIG. 1, includes input transistor stage 12, simple current mirror 14 and output transistor stage 16. Current mirror 14 includes first transistor stage 18 and second transistor stage 20. Current mirror 14 may also include degeneration resistors 19 and 21, their presence improving the accuracy of current mirror 14. Current mirror 14 provides a current gain substantially equal to Y which is the ratio of the collector current of transistor 20 to the collector current of transistor 18. Transistors 12 and 18 form first leg 26, and transistors 16 and 20 form second leg 28 of cascode mirror 10. Legs 28 and 26 are defined to carry a normalized nominal current of Y to 1, respectively. While each transistor is shown to include an NPN semiconductor device, they may equally be PNP semiconductor devices. In any case, both types of devices, which include a control terminal, and first and second load terminals, e.g., base, collector and emitter, will contribute similar, inherent current errors.

Input current source 22 provides an input current $I_{IN}$ into leg 26 which is mirrored as output current I at output node 24 of cascode current mirror 10, the collector of output transistor 16. Thus, any variation of the input current is also mirrored in the output current at the collector of output transistor 16. Base current modulation errors arise due to variations in the collector-to-emitter voltage of a transistor.

Accordingly, a change in voltage at output node 24, the collector of output transistor 16, causes a change in its collector-to-emitter voltage changing the base current of output transistor 16. Thus, to first order only output transistor 16 contributes a base current modulation error to the output of cascode current mirror 10.

An increase in voltage at node 24 by an amount $\Delta v$ produces an increase by the same amount at the collector of output transistor 16. Due to base current modulation the base current of output transistor 16 decreases a corresponding $Y \cdot \Delta i$ that passes from the base of output transistor 16 through diode connected input transistor 12 to diode connected first transistor 18. For the following analysis Y is given a value of 1. Thus, the collector current of first transistor 18 is increased by $Y \cdot \Delta i$, or $1 \cdot \Delta i$. Simple current mirror 14 causes the collector current of first transistor 18 to be seen at the collector of second transistor 20 multiplied by the current gain Y. Thus, $Y \cdot Y \Delta i$ is seen at the collector of second transistor 20. Accordingly, for Y equal to 1, the same $1 \cdot \Delta i$ seen at the collector of first transistor 18 is also seen at the collector of second transistor 20 of simple current mirror 14.

Therefore, if $1 \cdot \Delta i$ flows from the base of output transistor 16 to diode connected transistor 12 and $1 \cdot \Delta i$ flows from the emitter of output transistor 16 to the collector of second transistor 20, then the current error due to base current modulation seen at output node 24 of cascode current mirror 10, into the collector of output transistor 16, is equal to $2 \cdot \Delta i$. That is, $1 \cdot \Delta i$ from the base of transistor 16 to diode connected transistor 12 and $1 \cdot \Delta i$ from the emitter of transistor 16 to the collector of transistor 20 requires that $2 \cdot \Delta i$ must be introduced to the collector of output transistor 16. Note that the current error is amplified depending on the gain Y of the current mirror.

Figure 2:
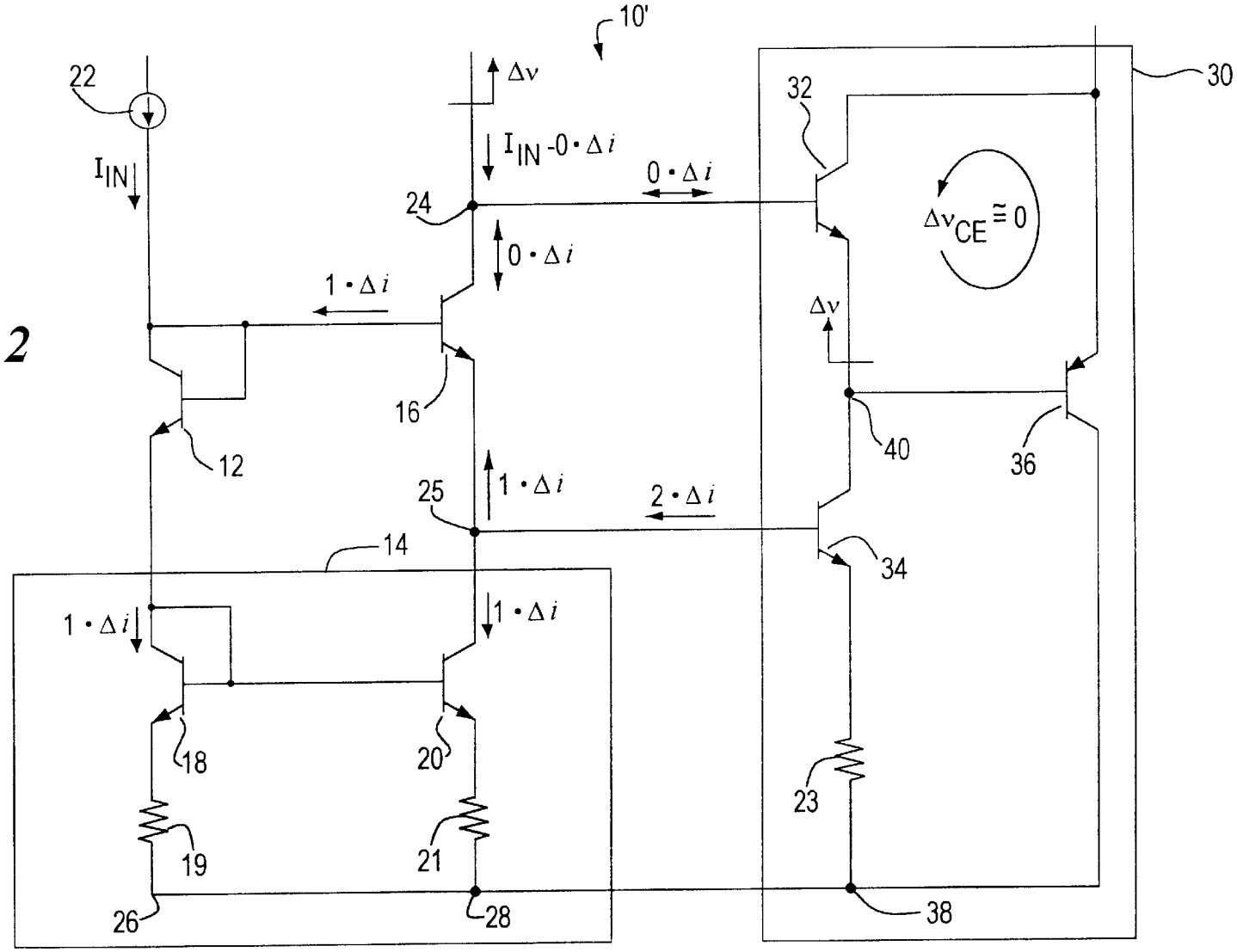
FIG. 2 is a detailed schematic diagram, similar to FIG. 1, of a compensated cascode current mirror demonstrating how the compensation circuit according to the present invention cancels base current modulation errors in the output stage of the cascode current mirror of FIG. 1.

Error compensated cascode current mirror 10' according to this invention, FIG. 2, includes error compensation circuit 30 which compensates for base current modulation errors in prior art cascode current mirror 10, FIG. 1.

Defining the nominal current through leg 26 as unity, the nominal current through leg 28 is equal to Y. Compensation circuit 30 includes first compensation transistor stage 32, second compensation transistor stage 34, bootstrapping buffer 36 and possibly degeneration resistor 23. First compensation 32 and second compensation transistor 34 are NPN semiconductor devices while bootstrapping transistor 36 is a PNP transistor. If, however, transistors 32 and 34 were PNP semiconductor devices then bootstrapping transistor 36 would be an NPN semiconductor device. No matter what type of semiconductor device is used, each device includes a control terminal and first and second load terminals. Compensation circuit 30 is connected to cascode current mirror 10 at nodes 24 and 25. The base of first compensation transistor 32 is connected to node 24, the collector of output transistor 16, and the base of second compensation transistor 34 is connected to node 25, the collector of second transistor 20. Bootstrapping buffer 36 is a PNP transistor with its base connected between the emitter of first compensation transistor 32 and the collector of second compensation transistor 34 at node 40. The emitter of bootstrapping buffer 36 is connected to the collector of first compensation transistor 32, bootstrapping the collector of transistor 32 to its emitter. First compensation transistor 32, second compensation transistor 34 and possibly degeneration resistor 23 form third leg 38 of compensated cascode mirror 10'. Legs 26, 28 and 38 of compensated cascode current mirror 10' carry normalized nominal currents of 1, Y and $Y \cdot (1+Y)$, respectively.

With Y equal to 1, output transistor 16 and second transistor 20 of current mirror 14, along with input transistor 12 and first transistor 18, each carry a normalized nominal current of 1. Further, first and second compensation transistors 32 and 34 carry a normalized nominal current of 1(1+1), or 2.

As discussed above, as the output voltage varies, the collector to emitter voltage of output transistor 16 also varies introducing a current error of $2 \cdot \Delta i$ at the output. Compensation circuit 30 cancels the base current modulation error as follows. As the output voltage increases by $\Delta v$ at node 24, very nearly the same increase in voltage is seen at compensation node 40 of compensation circuit 30, due to emitter follower action of first compensation transistor 32.

As discussed with reference to FIG. 1, a change in output voltage by some value $\Delta v$, results in a change in the output current by $2 \cdot \Delta i$. Bootstrapping buffer 36, in response to the change in voltage $\Delta v$, impresses very nearly the same change in voltage on the collector of first compensation transistor 32 such that there is essentially no change in the collector to emitter voltage of first compensation transistor 32, preventing base current modulation effects from occurring with respect to first compensation transistor 32. Furthermore, through emitter follower action of transistor 32, the change in voltage $\Delta v$ is impressed by first compensation transistor 32 onto the collector of second compensation transistor 34, node 40.

Just as a change in collector voltage of output transistor 16 introduced a base current modulation error of $Y \cdot \Delta i$ or $1 \cdot \Delta i$ for Y equal to 1 from the base of output transistor 16, the $\Delta v$ at node 40 changes the collector voltage of second compensation transistor 34 which, given transistor 34 carries a normalized nominal current of $Y \cdot (1+Y)$ or 2 for Y equal to 1, causes a current of $Y \cdot (1+Y)\Delta i$, or $2 \cdot \Delta i$ to flow from the base of second compensation transistor 34 toward node 25.

As discussed above, the collector current of second transistor 20, due to the base current modulation error of output transistor 16, includes an error term equal to $1 \cdot \Delta i$. Thus, at node 25, if $1 \cdot \Delta i$ exits node 25 into the collector of transistor 20 and $2 \cdot \Delta i$ enters node 25 from the base of second compensation transistor 34, then $1 \cdot \Delta i$ must exit node 25 toward the emitter of output transistor 16.

Moreover, if $1 \cdot \Delta i$ enters the emitter of output transistor 16 from node 25 and $1 \cdot \Delta i$ exits the base of output transistor 16, then no $\Delta i$ enters the collector of output transistor 16. Accordingly, the $2 \cdot \Delta i$, FIG. 1, previously seen at output node 24 due to base current modulation errors is cancelled. Thus, the compensation circuit according to the present invention, in response to a change in output voltage, uses the base current modulation error inherent to the compensation circuit to cancel the base current modulation error of the cascode current mirror where the first, second and third legs have a normalized nominal current ratio of 1, Y and $Y \cdot (1+Y)$, respectively.

Figure 3:
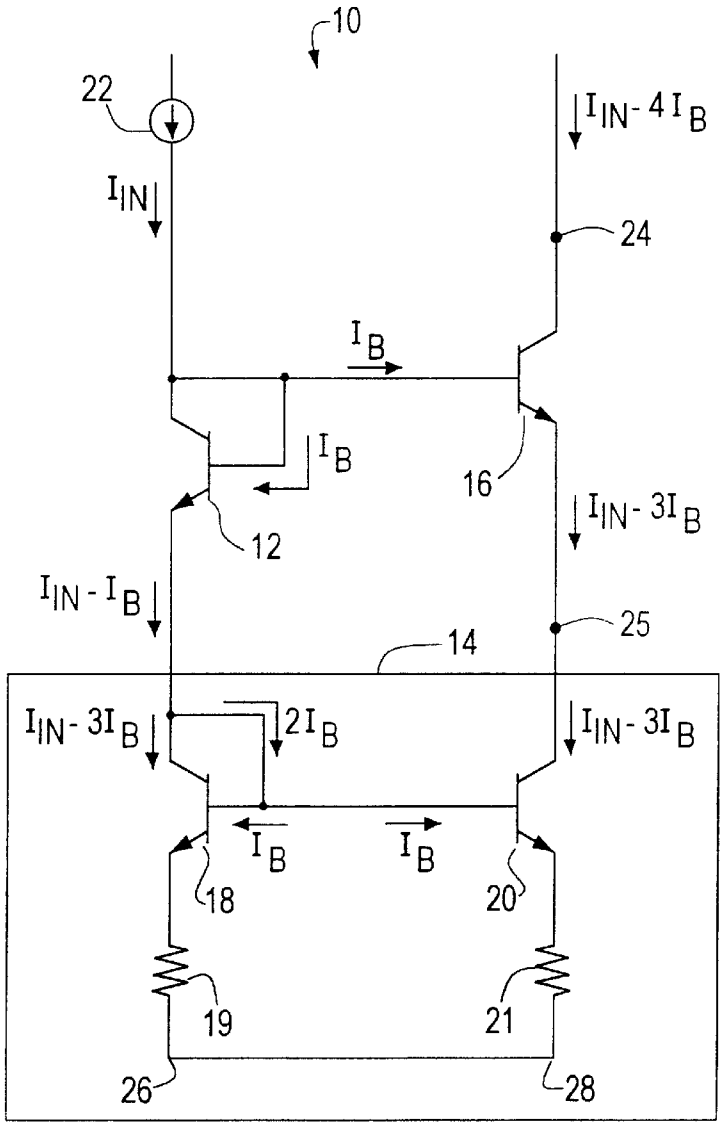
FIG. 3 is a detailed schematic diagram, similar to FIG. 1, demonstrating the effects of base current errors of the cascode current mirror on the output of the cascode current mirror.

Prior art uncompensated cascode current mirror 10, FIG. 3, demonstrates the effect of base current errors on the output current at node 24. Base current errors result from base current which inherently flows in response to collector current. Thus, as $I_{IN}$ is applied to the diode connected transistor 12 from current source 22, a portion flows to input transistor 12 as collector current and a portion is provided to the bases of transistors 12 and 16 as base current $I_B$, having given current gain Y a value of 1 for convenience.

The base current of input transistor 12 recombines with the collector current at its emitter to provide an emitter current equal to $I_{IN}-I_B$, the $-I_B$ term being the portion of current applied to the base of output transistor 16.

The current $I_{IN}-I_B$ is then applied to diode connected transistor 18 of simple current mirror 14. As with diode connected input transistor 12 above, a portion of the current applied to first transistor 18 is applied to each of the bases of first and second transistors 18 and 20 in an amount equal to $I_B$, thus the collector current of transistor 18 is equal to $I_{IN}-3I_B$.

Since simple current mirror 14 mirrors, at the collector of second transistor 20, the current seen at the collector of first transistor 18, the current applied to the collector of second transistor 20 is also equal to $Y \cdot (I_{IN}-3I_B)$, or $I_{IN}-3I_B$.

Accordingly, since the emitter current of output transistor 16 applied to the collector of second transistor 20 is $I_{IN}-3I_B$ and the emitter current is equal to the collector current of input transistor 16 plus the base current $I_B$ of output transistor 16, it follows that the collector current of output transistor 16, and thus the output current of cascode mirror 10, is equal $Y \cdot (I_{IN}-4I_B)$, or $I_{IN}-4I_B$. Thus, base current errors in cascode current mirror 10 result in a current error of $4I_B$ between the input current $I_{IN}$ and the output current.

Figure 4:
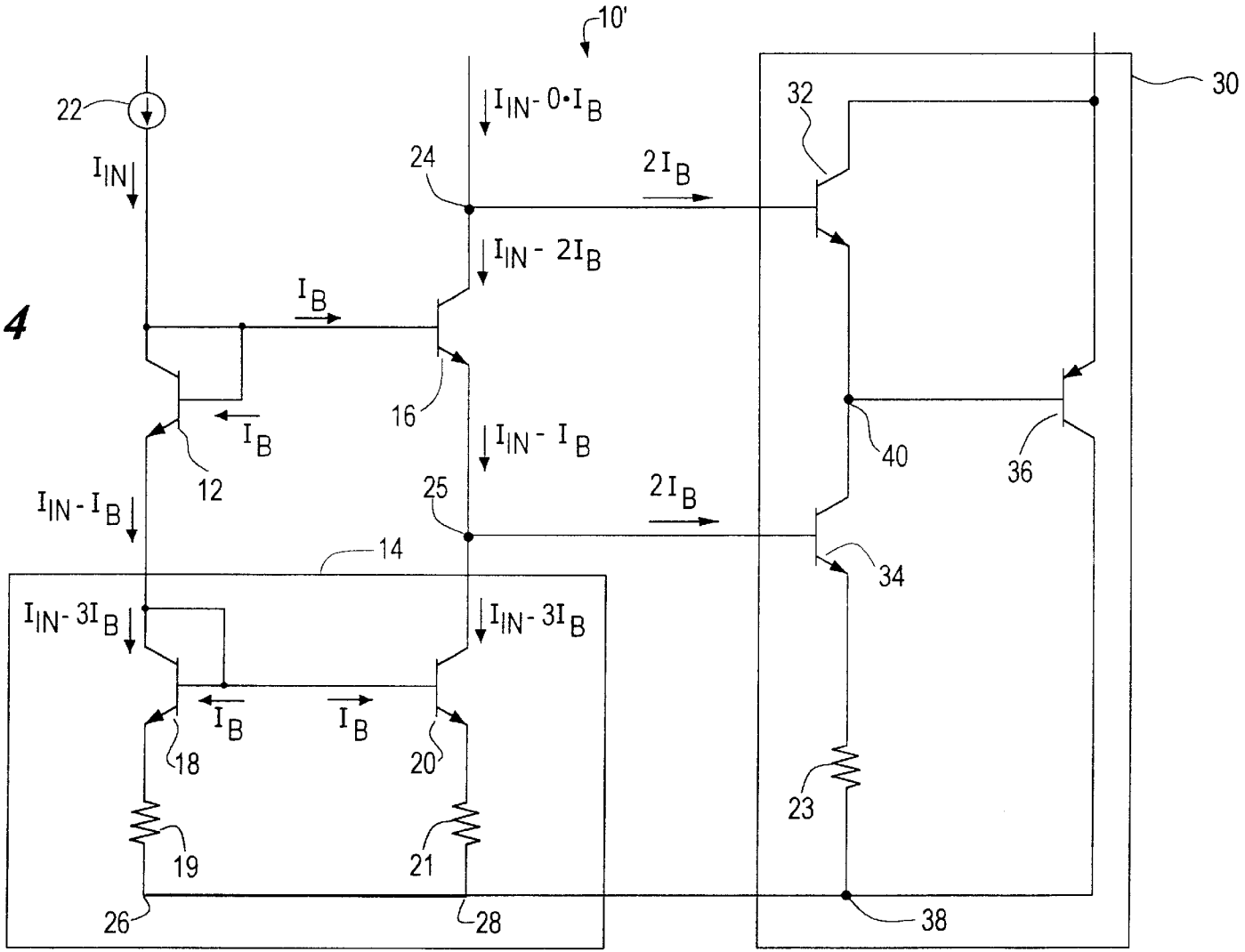
FIG. 4 is a detailed schematic diagram, similar to FIG. 2, of a compensated cascode current mirror demonstrating how the compensation circuit according to the present invention cancels base current errors in the output of the cascode current mirror of FIG. 3.

Compensated cascode current mirror 10' according to this invention, FIG. 4, includes compensation circuit 30. As discussed with reference to FIG. 2, first and second compensation transistor 32 and 34 carry a normalized current equal to $Y \cdot (1+Y)$. Furthermore, it is required that all transistors appearing in FIG. 2 run at substantially equal nominal beta, with the possible exception of transistors 12 and 36.

Accordingly, first compensation transistor 32 and second compensation transistor 34 will each have a base current of $Y \cdot (1+Y)\ I_B$. Thus, for Y equal to 1, the base current of each of first and second compensation transistors 32 and 34 is $2I_B$.

Referring to node 25, the collector current of second transistor 20 is equal to $I_{IN}-3I_B$, as discussed in FIG. 3, which exits node 25 and the base current to second compensation transistor 34 is equal to $2I_B$ also exiting node 25. Accordingly, the current entering node 25, that is the emitter current of output transistor 16, must be $I_{IN}-I_B$. Similarly, because the current exiting the emitter of output transistor 16 is equal to $I_{IN}-I_B$ and the current entering the base of output transistor 16 is equal to $I_B$, the collector current, or the current entering output transistor 16 is equal to $I-2I_B$.

The current exiting node 24 and entering first compensation transistor 32 is equal to $2I_B$. Accordingly, because the collector current exiting node 24 is $I_{IN}-2I_B$ and the base current exiting node 24 is $2I_B$, the current entering node 24, that is the output current of compensated cascode current mirror 10', must be equal to $I_{IN}-0I_B$. Thus, by ensuring that compensation transistors 32 and 34 run at normalized nominal current equal to $Y \cdot (1+Y)$, where Y is the current gain of simple current mirror 14, first and second compensation transistors 32 and 34 will require base currents, equal to the base current error generated by cascode current mirror 10, FIG. 2, to cancel the base current errors which otherwise appear in the output current. Thus, the output current of cascode current mirror 10' does indeed mirror the input current $I_{IN}$ from current source 22.

Thus, the compensation circuit according to the present invention, in addition to canceling base current modulation errors, requires inherent base current that cancels the base current error present in the cascode current mirror 10, FIG. 3, where the first, second and third legs of the compensated current mirror have normalized nominal current of 1, Y and $Y \cdot (1+Y)$, respectively. That is, the ratio of the nominal current of the cascode mirror output current to the input current is Y and the ratio of the nominal current of the compensation circuit to the input current is $Y \cdot (1+Y)$.

Although specific features of the invention are shown in some drawings and not in others, this is for convenience only as each feature may be combined with any or all of the other features in accordance with the invention.

Other embodiments will occur to those skilled in the art and are within the following claims:

What is claimed is:

1. An Early voltage and beta compensated cascode current mirror comprising:

a cascode current mirror having an input stage responsive to an input current, a current mirror circuit having a first stage responsive to the input stage and a second stage responsive to the first stage, and an output stage responsive to the second stage for providing an output voltage and current; and a compensation circuit, responsive to the cascode current mirror, having a first compensation stage, a second compensation stage and a bootstrapping buffer, the first compensation stage, in response to a change in the output voltage, impressing an equal change in voltage on the second compensation stage, the second compensation stage thereby providing a change in current to the cascode current mirror for cancelling current errors induced by base modulation effects in the output stage, the bootstrapping buffer, in response to the change in voltage, impressing an equal change in voltage on the first compensation stage to prevent errors from base current modulation in the first compensation stage, the first and second compensation stages further providing base currents to the cascode current mirror for cancelling base current errors in the output current induced by the cascode current mirror.

2. The error compensated cascode current mirror of claim 1 in which the input stage and first stage form a first leg, the output stage and second stage form a second leg and the first and second compensation stages form a third leg, the first, second and third legs having normalized nominal currents of 1, Y, and Y·(1+Y), respectively, where Y is the current gain of the cascode current mirror.

3. The error compensated cascode current mirror of claim 2 in which each said stage includes a transistor.

4. The error compensated cascode current mirror of claim 2 in which each said output, first and second stages and said first and second compensation stages includes a transistor and each transistor is running at substantially equal beta.

5. The error compensated cascode current mirror of claim 3 in which the input transistor and first transistor are diode connected.

6. The error compensated cascode current mirror of claim 5 in which the first compensation transistor provides a compensation current to the output transistor and the second compensation transistor provides a compensation current to the second transistor for canceling base current errors in the cascode current mirror.

7. The error compensated cascode current mirror of claim 6 in which the bootstrapping buffer is a PNP bipolar transistor and the remaining transistors are bipolar NPN transistors.

8. The error compensated cascode current mirror of claim 6 in which the bootstrapping buffer is an NPN bipolar transistor and the remaining transistors are bipolar PNP transistors.

9. The error compensated cascode current mirror of claim 1 in which said bootstrapping buffer includes an output node for tracking the voltage at said output stage.

10. The error compensated cascode current mirror of claim 1 in which at least one of said first stage, second stage and second compensation stage includes a degeneration impedance.

11. A beta and Early voltage compensation circuit for a current mirror having an output stage for providing an output voltage and current gain Y comprising:

a first compensation stage, responsive to a change in the output voltage;

a second compensation stage, responsive to the first compensation stage, for providing a current to the output stage; and a bootstrapping buffer stage, responsive to the change in output voltage, the bootstrapping buffer, in response the change in voltage, impressing an equal change in voltage on the first compensation stage to prevent errors from base current modulation effects in the first compensation stage, the first compensation stage, in response to the change in the output voltage, impressing a corresponding change in voltage on the second compensation stage, the second compensation stage thereby providing a change in current to the current mirror for cancelling current errors induced by base current modulation errors in the output stage, the first and second compensation stages further providing a base current to the cascode current mirror for cancelling base current errors introduced in the output current by the cascode current mirror.

12. The error compensation circuit of claim 11 in which the first and second compensation stages have a normalized nominal current of Y·(1+Y).

13. The error compensation circuit of claim 12 in which each said stage includes a transistor.

14. The error compensation circuit of claim 13 in which the bootstrapping transistor is a PNP bipolar transistor and the first and second compensation transistors are NPN bipolar transistors.

15. The error compensation circuit of claim 13 in which the bootstrapping transistor is an NPN bipolar transistor and the first and second compensation transistors are PNP bipolar transistors.

* * * * *